US005901528A

United States Patent [19]

Richardson

[11] Patent Number: 5,901,528

[45] Date of Patent: May 11, 1999

[54] BUILDING ELEMENTS

[75] Inventor: Christopher Richardson, Clitheroe, United Kingdom

[73] Assignee: Ultraframe Plc of Enterprise Works, United Kingdom

[21] Appl. No.: 08/901,507

[22] Filed: Jul. 28, 1997

[30] Foreign Application Priority Data

Oct. 11, 1996 [GB] United Kingdom ..... 9621198

[51] Int. Cl.[6] ..... E04C 3/00; E04B 2/00

[52] U.S. Cl. ..... 52/783.1; 52/580; 52/586.1; 52/582.1; 403/363

[58] Field of Search ..... 52/578, 580, 586.1, 52/584.1, 582.1, 783.1; 403/363, 292, 294, 335

[56] References Cited

U.S. PATENT DOCUMENTS

| | | | |
|---|---|---|---|
| 3,363,381 | 1/1968 | Forrest | 52/464 |
| 4,158,512 | 6/1979 | Hasselbacher | 403/294 |
| 4,258,703 | 3/1981 | Reitmaier . | |
| 4,486,994 | 12/1984 | Fisher | 52/303 |
| 4,790,112 | 12/1988 | Wang | 52/586.1 |
| 4,936,069 | 6/1990 | Hunter et al. | 52/586.1 |
| 5,580,620 | 12/1996 | Campbell et al. . | |

FOREIGN PATENT DOCUMENTS

| | | |
|---|---|---|
| 1511189 | 7/1976 | Denmark . |
| 0 006 431 A1 | 5/1979 | European Pat. Off. . |
| 0070930A1 | 8/1981 | European Pat. Off. . |
| 0 342 886A1 | 5/1989 | European Pat. Off. . |
| 0 522 541A1 | 7/1992 | European Pat. Off. . |
| 0 624 696A2 | 5/1994 | European Pat. Off. . |
| 1528874 | 7/1995 | Germany . |
| 1201427 | 10/1968 | United Kingdom . |
| 1528874 | 1/1976 | United Kingdom . |
| 2155527 | 3/1984 | United Kingdom . |
| 2147334 | 9/1984 | United Kingdom . |
| 2 207 930 | 7/1988 | United Kingdom . |
| 2243170 | 1/1991 | United Kingdom . |
| 2268765 | 6/1993 | United Kingdom . |

OTHER PUBLICATIONS

Examiner D.J. Lovell, Application No.: GB 9721298.9; Claims searched: 1–22; Patents Act 1977; Search Report under Section 17.

*Primary Examiner*—Carl D. Friedman
*Assistant Examiner*—Dennis L. Dorsey
*Attorney, Agent, or Firm*—Howell & Haferkamp, L.C.

[57] ABSTRACT

A hollow building element (10) of plastics material comprises one or more longitudinal ducts (30) and has at opposite sides thereof, coupling members (32, 34), whereby elements are connectable to each other directly or indirectly, wherein lower coupling members (34A, 34B) comprise ducted flanges (42, 50 respectively). Building structures comprise such hollow building elements (10) coupled side by side.

12 Claims, 1 Drawing Sheet

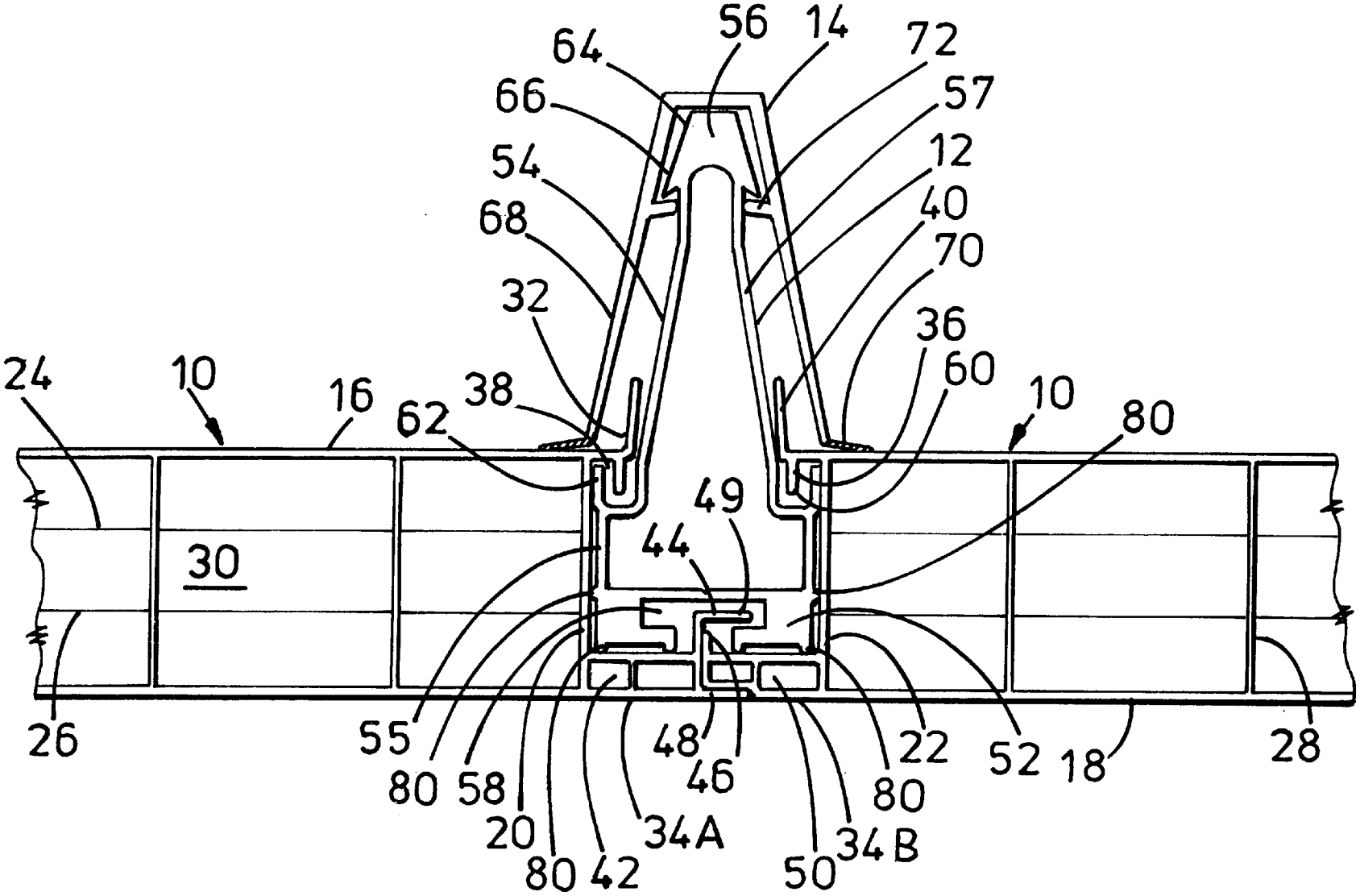
28
18
80
10
52
22
80
34B
50
72
57
12
40
70
36
60
14
56
49
44
46
48
34A
42
64
66
54
68
32
38
62
80
20
58
80
55
16
30
10
24
26

BUILDING ELEMENTS

This invention concerns building elements for making structures and structures made from such building elements.

Self-supporting roofs or roof sections are known which comprise a plurality of extruded plastics profile elements connected side-by-side, each element having at least one longitudinal chamber or duct and coupling members, by which neighbouring profile elements are interconnected, the adjacent coupling members of neighbouring profile elements engaging to form a duct.

In GB 1528874, the coupling of adjacent panels form together a duct through which is inserted a longitudinally elongate locking member, the locking member having at least two opposite longitudinal edges that are a sliding fit within the duct, so as to prevent the locking member from twisting under load.

In GB 1511189, it was further proposed that the longitudinal chamber of each element have an internal partition substantially parallel to the outer surfaces of a building structure made up of the elements. The partition was principally to provide additional heat insulation.

Further proposals for such profile elements have been made in EP-A-070930, in which multiple duct elements have main ducts and intermediate secondary ducts having internal partitions that are in line. Connection of these elements together is as disclosed in GB 1511189 and GB 1528874.

A yet further proposal for such elements was made in GB 2147334A, in which upper coupling members consist of cylindrical, slotted downwardly open flanges of such dimension that a flange of a first element can be snap locked to a flange of a second identical element. In addition, the lower end of one side wall of an element is integrally connected to a guide member which is adapted to engage the anchoring member of an adjacent element so as to maintain the lower ends of two adjacent side walls in spaced relationship so as to form a tight connection between such elements.

In our own Patent Application No. GB 2268765A, we propose a hollow building element of plastics material comprising a plurality of hollow ducts in two layers and having, at opposite sides thereof coupling members, whereby elements may be connected to each other, upper coupling members comprising a part engageable with a stiffening or reinforcing beam.

A problem with all of the above-described building elements lies in the formation of cold spots causing condensation. The cold spots are formed where elements are coupled together, because aluminium stiffening beams used to reinforce and in most cases to hold elements together are in contact with single layers of plastics material forming coupling flanges providing a path for heat loss by conduction.

An object of this invention is to provide building elements for making structures which are less susceptible to formation of cold spots.

According to this invention there is provided a hollow building element of plastics material comprising one or more longitudinal ducts and having, at opposite sides thereof, coupling members, whereby elements may be connected to each other directly or indirectly, wherein lower coupling members comprise ducted flanges to provide an insulation barrier.

The invention further provides a building structure such as a roof, comprising two or more hollow building elements connected side by side, the hollow building elements comprising one or more longitudinal ducts and having, at opposite sides thereof, coupling members whereby the elements are connected to each other directly or indirectly, wherein lower coupling members comprise ducted flanges to provide an insulation barrier.

The lower coupling members preferably each comprise two or more longitudinal ducts.

Preferred building elements of the invention may have a single longitudinal duct, a single layer of adjacent longitudinal ducts, a pair of longitudinal ducts one on top of the other, or a plurality of longitudinal ducts in two or more layers, especially three layers.

Each building element preferably has a different lower coupling member at each end and the two types of lower coupling member are preferably complementary so as to fit together when elements are coupled side by side.

Preferably lower coupling members are arranged to be held together by means of a reinforcing beam between adjacent elements. Preferably one lower coupling member comprises a horizontal channel in which the end of another coupling member sits, each member having a part extending upwardly which parts are prevented from separating by more then a desired distance by means of the reinforcing beam. The preferred reinforcing beam has a longitudinal slot in its base in which said upwardly extending parts of the lower coupling members locate.

The building elements of the invention preferably also have upper coupling members. Preferred such members interengage with formations of a reinforcing beam between adjacent building elements. A preferred upper coupling member comprises a flange forming a channel section which is engageable in a complementary channel section of the reinforcing beam.

The reinforcing beam preferably has ribs or the like on its outer surface particularly in its lower regions in order to limit areas of contact between the beam and the building elements in the space between adjacent elements.

For coupled building elements according to the invention it is preferable to provide a cap or cover over the area of the coupling to prevent water ingress. Preferably the cap or cover is securable to the reinforcing beam. The cap or cover preferably has at its side edges sealing means in the form of flexible resilient material, preferably extruded with the cap or cover. The reinforcing beam preferably has a formation engageable with a formation of the cap or cover to retain the cap or cover in place.

The reinforcing beam may have a head forming lips on opposite sides which serve to retain internal ribs of the cap or cover when pressed onto the beam and past the head thereof.

The building elements of the invention will usually be made of plastics material, such as polyvinyl chloride or preferably polycarbonate.

This invention will now be further described, by way of example only, with reference to the accompanying drawing, which shows part of a building structure made up of building elements of the invention.

Referring to the accompanying drawing, a building structure, such as a conservatory roof, comprises building panels 10 of plastics material, such as polycarbonate, connected together side by side to and by means of aluminium reinforcing beams 12. The connection of adjacent panels 10 is sealed by a capping 14 pressed onto the beam 12.

The building panels 10 are hollow and have flat top and bottom walls 16, 18 respectively, end walls 20, 22, intermediate walls 24, 26 parallel to the top and bottom walls and intermediate walls 28 parallel to the end walls, thereby forming ducts 30 through the panels in three rows on top of each other. The intermediate walls 24, 26 and 28 are generally thinner than the outer walls of the panels.

At each end of the panels are upper and lower coupling members 32, 34 respectively. The upper coupling members are the same at each end of the panels, whereas the lower coupling members 34A at one end of the panels are different to the coupling members 34B at the opposite ends of the panels.

The upper coupling members 32 each comprise a flange which is a continuation of top wall 16. The flange has a downwardly projecting part 36 forming, with the end wall of the panel, a downwardly open channel 38 and just beyond the part 36 an upward projection 40.

The lower coupling member 34A comprises a ducted flange 42 extending from the end wall of the panel and terminating with a square C-section part 44 forming a horizontal channel 46 with a bottom wall 48 and a top wall 49, the channel being of greater height than the flange 42. The lower coupling member 34B comprises a ducted flange 50 extending from the opposite end wall of a panel top the coupling member 34A. The flange 50 has its bottom edge stepped upwards at its remote end from the panel to accommodate bottom wall 48 of the coupling member 34A, when two adjacent panels are brought together.

The reinforcing beam 12 is formed as a hollow extrusion and has a base 52, sides 54 and a top 56. The sides extend upwardly in parallel for a first part 55 before converging towards the top 56 for a second part 57. The base 52 is formed with a channel 58 therealong with rebated sides in order to accommodate top wall 49 of a coupling member 34A.

Where the first and second parts of the beam 12 meet, the beam has a pair of upwardly open channels 60 that have an outer wall 62 as a continuation of first wall part 55 and an inner wall that continues to form the second wall part 57. The channels 60 accommodate the flange parts 36 of the upper coupling members 32. The beam base 52 and the first part of the sides 55 of the beams have ribs 80 therealong in order to reduce the areas of contact between the beam and the panels, thereby reducing likelihood of heat loss through a panel connection.

The top 56 of the beam has an enlarged head 64 with downwardly divergent sides forming a lip 66 on each side. The lips 66 are to retain the capping 14. The capping 14 has downwardly divergent sides 68 with coextruded gasket material 70 along their bottom edges to seal against the top walls of the panels when the capping 14 is pressed into place on top of the beam 12. Internally the capping has on each side ribs 72 that are sufficiently deformable to pass over the head 64 of the beam but be retained beneath the head by the lips 66.

To construct a roof using building panels 10, the panels are laid side-by-side on a structure providing support at opposite ends of the panels with the lower coupling members 34A and B engaged. A beam 12 is then slid into the space between the panels to hold the lower coupling members together and to engage the upper coupling members. Then a capping is pressed onto the beam until it seats into the panels and is engaged on the heads of the beam.

The lower coupling members being ducted i.e., having an air space therein, provide greater insulation and inhibit condensation in the regions of contact with the beam.

I claim:

1. A building structure comprising two or more hollow building elements connected side-by-side, the hollow building elements comprising a plurality of longitudinal ducts and having, at opposite sides thereof, upper and lower coupling members, whereby elements are connected to a reinforcing beam between adjacent elements, the lower coupling members each comprising at least two longitudinal ducts, the reinforcing beam being of hollow section and having a base, sides, and a head, the head being shaped for retaining a cap over said connection between adjacent elements, the reinforcing beam having only localized areas of contact between itself and the elements connected thereto, and a cap retained on the head of the reinforcing beam.

2. A building structure as claimed in claim 1, wherein the building elements have a different lower coupling member at each end, the two types of lower coupling member being complementary.

3. A building structure as claimed in claim 1, wherein the cap has internal ribs that locate below the head of the reinforcing beam when pressed down thereon.

4. A building structure as claimed in claim 1, wherein the cap has free edges along each of which is coextruded gasket material that seals against top walls of the building element.

5. A building structure as claimed in claim 1, wherein one lower coupling member comprises a channel in which an end of another coupling member sits, each member having a part extending upwardly, which parts are prevented from separating by more than a desired distance by means of the reinforcing beam.

6. A building structure as claimed in claim 5, wherein the reinforcing beam has a longitudinal slot in its base in which said upwardly extending parts of the lower coupling members are located.

7. A building structure as claimed in claim 1, wherein the reinforcing beam has ribs on its outer surface to limit areas of contact between the beam and the adjacent building elements.

8. A building structure as claimed in claim 7, wherein the ribs are on the base of the reinforcing beam.

9. A building structure as claimed in claim 1, wherein the upper coupling members are interengaged with formations of a reinforcing beam between the adjacent elements.

10. A building structure as claimed in claim 9, wherein the upper coupling members comprise a flange forming a channel section interengaged in a complementary channel section of the reinforcing beam.

11. A building structure as claimed in claim 10, wherein the reinforcing beam has a first part between the adjacent elements and a second part extending above the adjacent elements.

12. A building structure as claimed in claim 11, wherein the complementary channel sections of the reinforcing beam are intermediate said first and second parts thereof.

* * * * *